US005718347A

United States Patent [19]

Walker et al.

[11] Patent Number: 5,718,347

[45] Date of Patent: Feb. 17, 1998

[54] CHILD RESISTANT, USER FRIENDLY CONTAINER AND CLOSURE

[76] Inventors: Charles B. Walker; Bradford Dunn Walker, both of 1511 Pauline Ave., Rockford, Ill. 61101

[21] Appl. No.: 644,518

[22] Filed: May 10, 1996

[51] Int. Cl.[6] ..... B65D 50/08

[52] U.S. Cl. ..... 215/209; 215/237; 220/324; 220/339; 220/283

[58] Field of Search ..... 215/206, 209, 215/237; 220/263, 264, 324, 339, 281, 282, 283

[56] References Cited

U.S. PATENT DOCUMENTS

| | | | |
|---|---|---|---|
| 3,187,975 | 6/1965 | Graybill . | |
| 3,187,977 | 6/1965 | Graybill . | |
| 3,266,055 | 8/1966 | Graybill . | |
| 3,419,198 | 12/1968 | Pettersen . | |
| 4,022,352 | 5/1977 | Pehr . | |
| 4,262,802 | 4/1981 | Laauwe . | |
| 4,467,931 | 8/1984 | Gach | 215/237 |
| 5,082,114 | 1/1992 | Bunin | 206/539 |
| 5,285,917 | 2/1994 | Hofmann | 220/212.5 |
| 5,544,770 | 8/1996 | Travisano | 215/230 |
| 5,575,399 | 11/1996 | Intini | 220/326 |
| 5,630,508 | 5/1997 | Petit | 206/387.1 |

*Primary Examiner*—Stephen Cronin
*Attorney, Agent, or Firm*—Wood, Herron & Evans, L.L.P

[57] ABSTRACT

A container and closure for medicine, pills or the like includes a latch connected to the closure by a living hinge. The closure is connected to the container opposite from the latch by a second living hinge. The latch is seated within a recess on the sidewall of the container to provide a child resistant package. A cavity is formed between the sidewall and the latch in the recess. The latch must be depressed by the user to free a portion of the latch from the recess. The remainder of the latch is dislodged from the recess by pressing on a region of the sidewall of the container. The closure can then be opened by grasping the latch and pulling upwardly thereby freeing the closure from the upper rim of the container. The unitary container and closure provide an effective child resistant package which is likewise easily opened by an adult or senior citizen.

22 Claims, 4 Drawing Sheets

CHILD RESISTANT, USER FRIENDLY CONTAINER AND CLOSURE

BACKGROUND OF THE INVENTION

This invention relates to a container and closure therefor, and more particularly, to a child resistant and user friendly container and closure for medicine, pills, and various other items.

Commonly, prescription medicines, pills, or other items must be packaged in child resistant containers for both regulatory compliance and safety reasons. Known child resistant containers and closures have taken numerous designs, many of which either are very difficult for even adults to easily open, provide inadequate resistance to children, or both. Many known child resistant designs fail because the child is either strong enough to overcome the various safety features or is capable of manipulating the package until it is opened. A particularly difficult aspect to this problem is the need for an effective child resistant cap which can easily and safely be used by the elderly or other adults with manual dexterity problems.

Typically, when filling a prescription a pharmacist must transfer the prescribed pills or medication from a large container to a smaller, child resistant container, pill box or vile. Very often such smaller containers are separate from their accompanying closure or lid. After the container is filled the pharmacist must identify and locate the appropriate closure or lid for that container. As a result, the use of separate containers and closures presents an added step for the pharmacist in filling the prescription and inventory and stocking problems for each of the various container and closure combinations, designs and sizes. Furthermore, if the end user loses, misplaces or damages the closure, the container is no longer child resistant and the pills or other medicine may spill or fall out of the open container during storage or use.

A tamper evident indicator is very beneficial for safety as an addition to the many known designs for child resistant containers. However, it is often very difficult to effectively incorporate a tamper evident feature into known child resistant container and closure designs.

SUMMARY OF THE INVENTION

It has therefore been a primary objective of this invention to provide an improved container and closure for pills, medicine, and other similar items.

It has been a further objective to provide such a container and closure which offers effective resistance to opening by a child but can be conveniently and easily opened and closed by an adult.

It has been a still further objective of this invention to provide such a container and closure combination which overcomes the inventory and use problems associated with separate containers and closures.

A still further objective of this invention is to provide such a container and closure which can effectively accommodate a tamper evident indicator without complicating or diminishing the effectiveness of the child resistant design.

These and other objectives of the invention have been attained by a container and closure combination which, in a presently preferred form, is injection molded plastic with the closure connected to the container by a living hinge. As a result, the container is integrally formed with the closure and the closure cannot be misplaced separate from the container. Therefore, the inventory problems associated with separate containers and closures for the various sizes and designs is eliminated.

Moreover, the container and closure of this invention is child resistant. A latch is connected to the closure with a living hinge and as such is integrally formed with the container and closure during the injection molding process. The closure is sized and configured to fit within the upper open rim of the container to thereby close and seal the container. When the container is closed, the latch can be seated within a recess in a sidewall of the container. The contour of the latch is tapered and/or a detent is provided on the latch to inhibit the closure from being forced upwardly and thereby pulling the latch from the recess.

The container can be easily opened by an adult following a simple three step process. First, a flexible portion of the latch is depressed by the user to deflect this portion of the latch toward a cavity between the latch and the sidewall of the container. When the flexible portion is depressed, the end of the latch which preferably includes the detent is dislodged or pops up from the recess. Second, a pressure region on the sidewall of the container is depressed by the user thereby dislodging or popping up the remaining portion of the latch from the recess. Once the latch is released from the recess in the sidewall of the container, the third step is for the user to grasp the latch and pull the closure away from the upper rim of the container and thereby pivoting the closure about the living hinge connecting the container and the closure. An optional fourth step may be included which includes initially tearing or peeling away a tamper evident band or label which covers at least a portion of the latch when it is seated within the recess. The container can be easily closed by pressing the closure back into the rim of the container and pressing the latch into the recess and thereby sealing the container and providing a child resistant package.

The container and closure of the present invention provides effective child resistance without being difficult for a senior citizen or other adult with manual dexterity problems to open and use. Furthermore, the closure and latch are integrally formed with the container to provide a unitary device which simplifies manufacturing and inventory problems.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figures 1, 2, 6A:
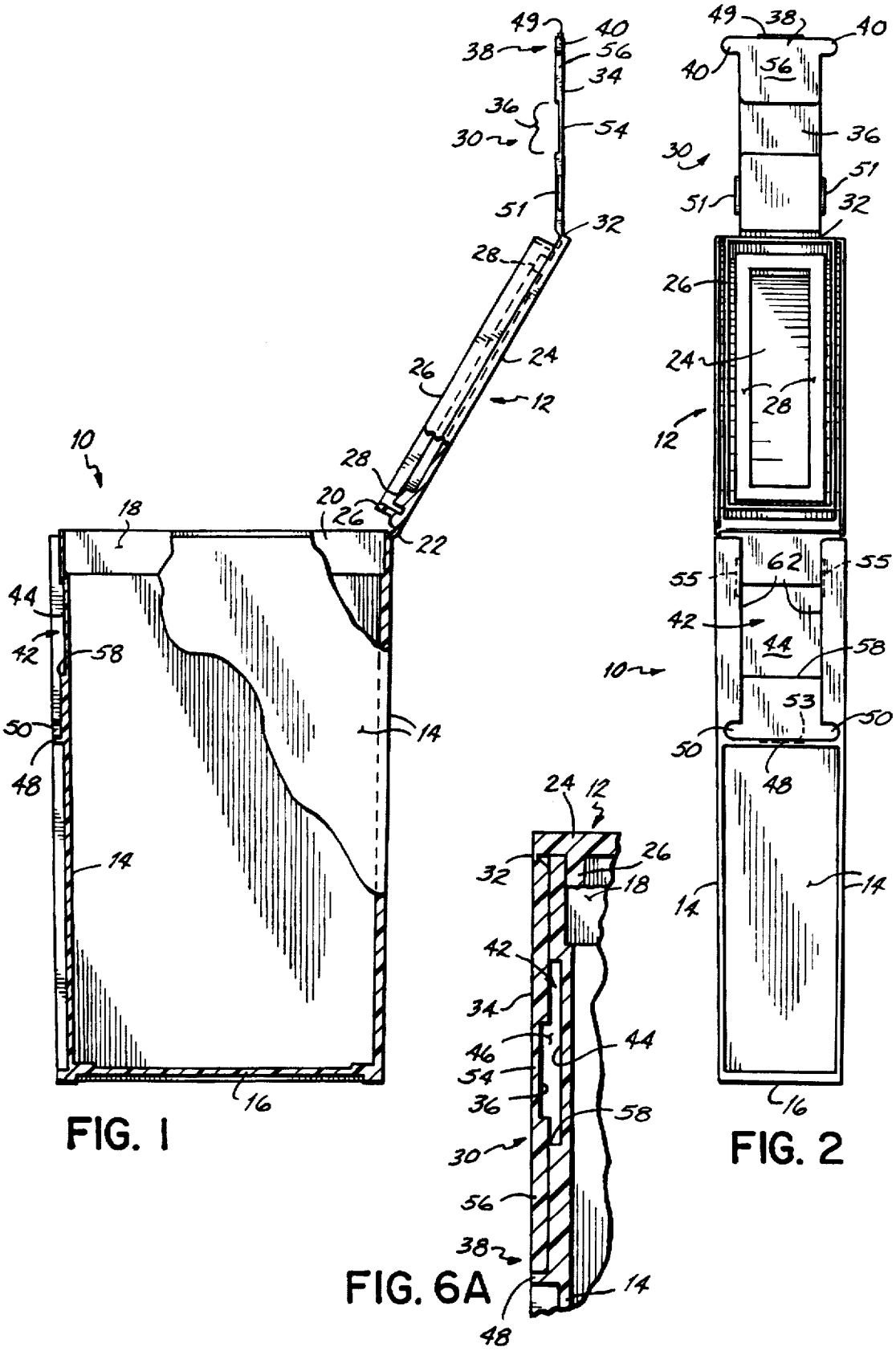
FIG. 1 is a partial cross-sectional side view of a first presently preferred embodiment of the container and closure according to this invention with the closure in an open position.
FIG. 2 is a front view of the container and closure of FIG. 1.
FIG. 6A is an enlarged cross-sectional view taken along line 6A—6A of FIG. 6.

Referring to FIGS. 1 and 2, a first presently preferred embodiment of a container 10 and a closure 12 according to this invention is shown. The container 10 includes a sidewall 14, a bottom 16 and an upper rim 18 extending around the periphery of the upper edge of the sidewall 14 to define an opening 20 of the container 10 through which medicine, pills or other items may be inserted and dispensed. The closure 12 is hingedly connected to the upper rim 18 by a living hinge 22. The closure 12 includes an upper panel 24 and a projecting lip 26 extending around the periphery of the panel 24 such that when the closure 12 is pivoted downwardly towards the opening 20, the lip 26 mates with the upper rim 18 to thereby seal the container 10 in a closed configuration. A reinforcing rib 28 is also included on the closure 12 and extends around the perimeter of the closure 12 inside of the lip 26 to add strength and rigidity to the closure 12.

The closure 12 includes a latch 30 hingedly connected by a living hinge 32 at a location opposite from the living hinge 22 connecting the closure 12 to the container 10. The latch 30 includes a first generally planar outer face 34 and an opposite face having a depressed notch 36, the purpose of which will be described hereinbelow.

A detent 38 in the form of a pair of tabs 40, each of which extend generally laterally from side edges at the terminal end of the latch 30 is formed. The terminal end of the latch 30 is opposite from the living hinge 32.

Figure 6:
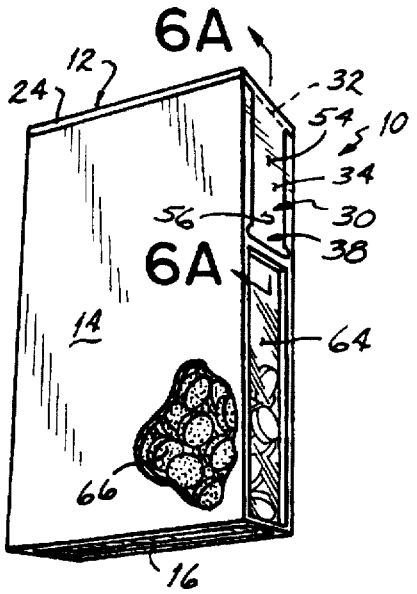
FIG. 6 is a perspective view partially broken away showing a viewing panel and the contents of the container of FIG. 1.

A recess 42 is formed in a face of the sidewall 14 of the container 10 opposite from the living hinge 22 connecting the closure 12 to the container 10. The recess 42 is sized and configured to receive therein the latch 30 when the closure 12 is mated with the upper rim 18 of the container 10 and the latch 30 is pivoted downwardly about the living hinge 32 (FIG. 6). The recess 42 includes a depressed well 44 which, when the latch 30 is seated within the recess 42, is generally aligned with the notch 36 so that the well 44 and the notch 36 in cooperation define a cavity 46 between the latch 30 and the sidewall 14 of the container 10 (FIG. 6A). A ledge 48 is also provided in the sidewall 14 to inhibit a child or someone else from prying the latch 30 from the recess 42.

Preferably, the ledge 48 is proximate the detent 38 thereby minimizing direct access to the detent 38 seated within the recess 42. The detent 38 advantageously prohibits a child or other unauthorized user from pulling the closure 12 upwardly from the rim 18 and thereby forcing the latch 30 out of the recess 42. The tabs 40 of the detent 38 are seated within lobes 50 of the recess 42 thereby inhibiting the latch 30 from translating or sliding upwardly within the recess 42 if pressure or force is applied to the closure 12 in an upward direction. As such, the cooperating detent 38 and lobes 50 in the recess 42 provide a significant resistance to someone forcing the container 10 open. A force greatly in excess of that of which a child is likely capable is required to deform the detent 38 and force the closure 12 open in such a manner, thereby providing a child resistant container 10 and closure 12.

An optional feature of the container 10 and closure 12 is shown in FIG. 2. Specifically, a ridge 49 is formed on the terminal edge of the latch 30 and lateral ridges 51 are formed on the side edges of the latch 30. A socket 53 is formed in the ledge 48 to mate with the ridge 49 when the latch 30 is seated within the recess 42. Similarly, lateral sockets 55 are provided in the side edges of the recess 42 for mating with the lateral ridges 51. The mating ridges 49, 51 and sockets 53, 55 provide an added measure of security or resistance to opening of the closure 12. For example, if a child tries to mutilate the container 10 and closure 12 by kicking, stomping, or throwing it the mating ridges 49, 51 and sockets 53, 55 will further inhibit forced or inadvertent opening of the closure 12.

Preferably, the container 10 and closure 12 are manufactured in a plastic injection molding process so that the container 10, closure 12, and latch 30 are formed as a single integral piece. As such, the inventory and logistic problems associated with separate containers and closures are avoided with the present invention. Preferably, the sidewall 14 of the container is tapered such that the upper rim 18 has a slightly larger dimension than the bottom 16 so that the container 10 can be easily removed from the injection mold (not shown).

Figure 3:
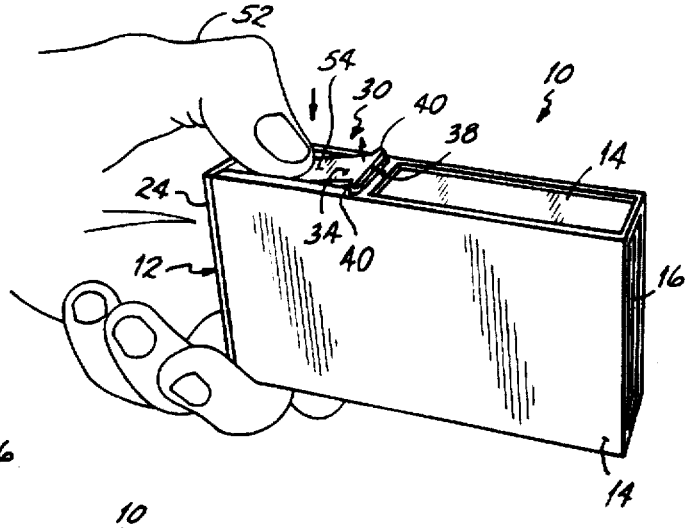
FIGS. 3–5 are sequential views showing the process of opening the closed container of FIG. 1.
Figure 4:
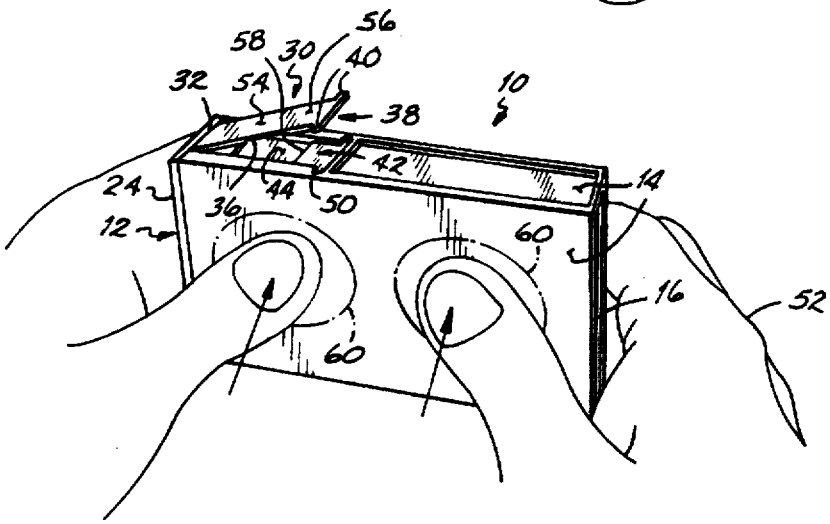
Figure 5:
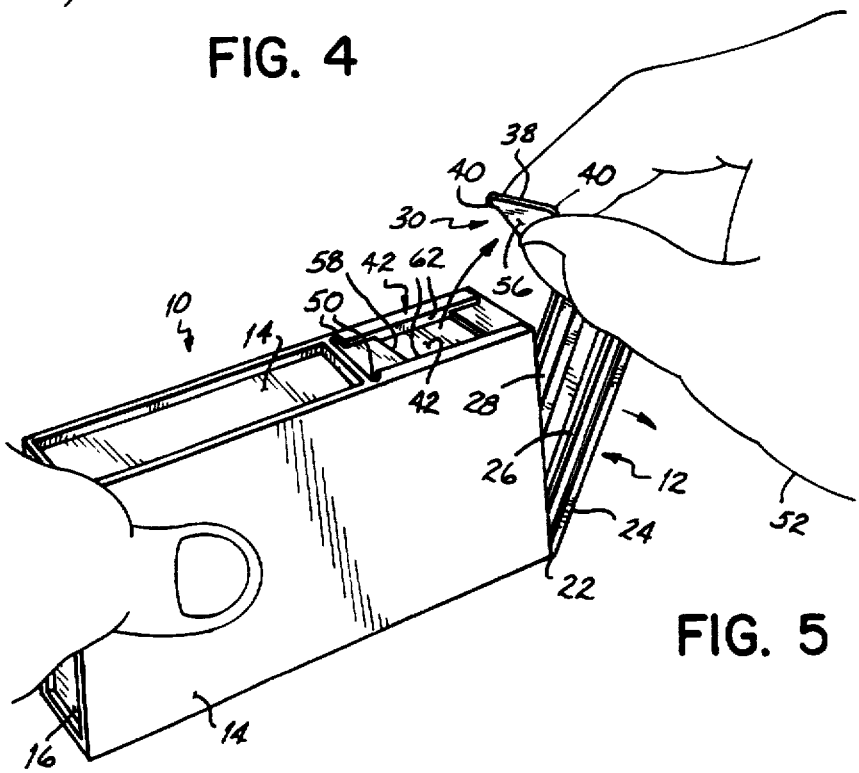

The process of opening the closed container 10 according to this invention is schematically and sequentially shown in FIGS. 3–5. An initial step in opening the container 10 is shown in FIG. 3 wherein the latch 30 is seated within the recess 42 in the sidewall 14 of the container 10 and a user 52 grasps the container 10 and presses downwardly on a flexible portion 54 of the latch 30. The flexible portion 54 of the latch 30 is formed by the reduced thickness of the latch 30 proximate the notch 36 and downward pressure on the flexible portion 54 forces the flexible portion 54 toward the cavity 46. As a result, a first portion 56 of the latch 30 pops upwardly thereby dislodging the terminal end of the latch 30 and preferably the detent 38 from the recess 42. In response to the downward pressure on the flexible portion 54 of the latch 30, an edge 58 of the well 44 closest to the terminal end of the latch 30 acts as a fulcrum against the latch 30 thereby popping the first portion 56 of the latch 30 upwardly from the recess 42. The ridge 49 will become dislodged from the socket 53 as a result of this initial opening step if these features are included on the closure 12 and container 10.

A second step in the process of opening the container 10 according to this invention is pressing inwardly on pressure regions 60 of the sidewall 14 on both sides of the recess 42. Squeezing or depressing the pressure regions 60 of the sidewall 14 pulls the side edges 62 of the recess 42 slightly away from the latch 30 thereby releasing the remaining portion of the latch 30 from the recess 42 and permitting the spring force of the living hinge 32 to pop the latch 30 upwardly as shown in FIG. 4. The lateral ridges 51 will become dislodged from the respective lateral sockets 55 as a result of this second step if these features are included on the closure 12 and container 10.

The final step of opening the container 10 is shown in FIG. 5 wherein the user 52 grasps the latch 30 after it is released from the recess 42 and pivots the latch 30 upwardly about the living hinge 32 thereby pulling the closure 12 from the rim 18 of the container 10 and pivoting the closure 12 about the living hinge 22 to open the container 10.

The combined steps of depressing the flexible portion 54 of the latch 30 to dislodge the first portion 56 of the latch 30 from the recess 42 and subsequently squeezing or pressing the pressure regions 60 of the sidewall 14 proximate the recess 42 and thereby releasing the remaining portion of the latch 30 from the recess 42 and then grasping and pulling the latch 30 provide a simple and effective technique for opening the container 10.

It will be appreciated that the sequential steps for opening the container 10 of this invention can be easily accomplished by a senior citizen or other person with limited manual dexterity. Moreover, the steps required for opening the container 10 are neither readily apparent nor easily discerned by a child. As a result, the container 10 and closure 12 according to this invention is both child resistant and senior friendly.

Closing the container 10 is very simply accomplished by pivoting the closure 12 downwardly about the living hinge 22 connecting it to the container 10 so that the lip 26 of the closure 12 mates with the rim 18 of the container 10 to provide an effective seal between the container 10 and closure 12. The next step in closing the container 10 is pivoting the latch 30 downwardly toward the sidewall 14 of the container 10 about the living hinge 32 connecting it to the closure 12 and then forcing the latch 30 into the recess 42 to thereby provide a child resistant package. Alternatively, if an adult wishes to avoid the child resistant feature of this invention, he or she would simply not press the latch 30 into the recess 42. The mating closure 12 and upper rim 18 of the container 10 provide an effective seal against inadvertent or unwanted opening of the package during storage or handling. For the user 52 to open the container 10 without the latch 30 seated within the recess 42, he or she merely pulls upwardly on the latch 30 as shown in FIG. 5.

Referring to FIG. 6, a viewing panel 64 providing visual access to the contents 66 of the container 10 is preferably included in the sidewall 14. The viewing panel 64 can be formed in the sidewall 14 during the injection molding process. The viewing panel 64 is a more translucent or more transparent portion of the sidewall 14.

Figure 7:
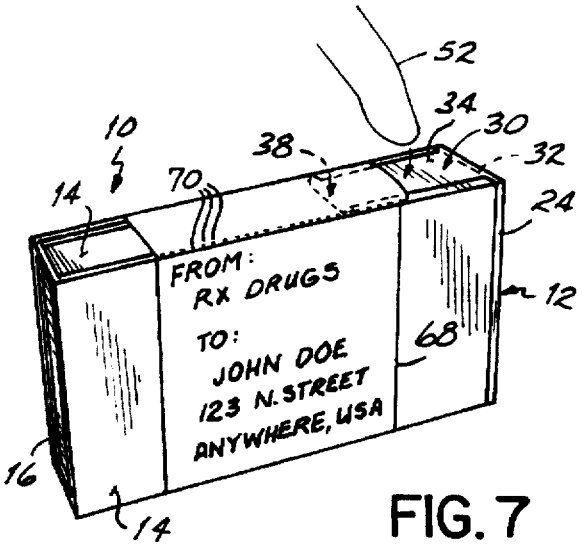
FIG. 7 is a perspective view of a tamper evident label applied to the first embodiment of the container and closure and a user about to remove the tamper evident label.

Another feature of the present invention is shown in FIG. 7 and includes a tamper evident indicator comprising a label 68 adhesively or otherwise affixed to the sidewall 14 wherein a portion of the label 68 covers at least a portion of the latch 30 seated within the recess 42. When the latch 30 is seated within the recess 42 a generally flush or planar surface is presented on the container 10 thereby providing a surface for the label 68 and enhancing the aesthetics and functionality of the invention and minimizing the likelihood that the latch 30 or other components may be damaged, snagged or broken during handling. The tamper evident label 68, if broken or damaged upon receipt by the user, indicates that the contents 66 may have been tampered with or compromised and as such provides an important warning to the user. The tamper evident label 68 preferably includes perforations 70 or lines of weakness which enable the user to peal the portion of the label 68 covering the latch 30 and surrounding area away from the container 10 prior to opening the container 10 as shown in FIGS. 3–5.

The container 10 and closure 12 of this invention can be manufactured in convenient sizes and sturdy configurations such that it can be mailed or otherwise transported without damaging or compromising the contents 66. The tamper evident label 68 may include an address portion. As such, the container 10 and closure 12 of this invention can be advantageously used for mail order prescriptions, shipment by pharmacies or the like.

Figure 8:
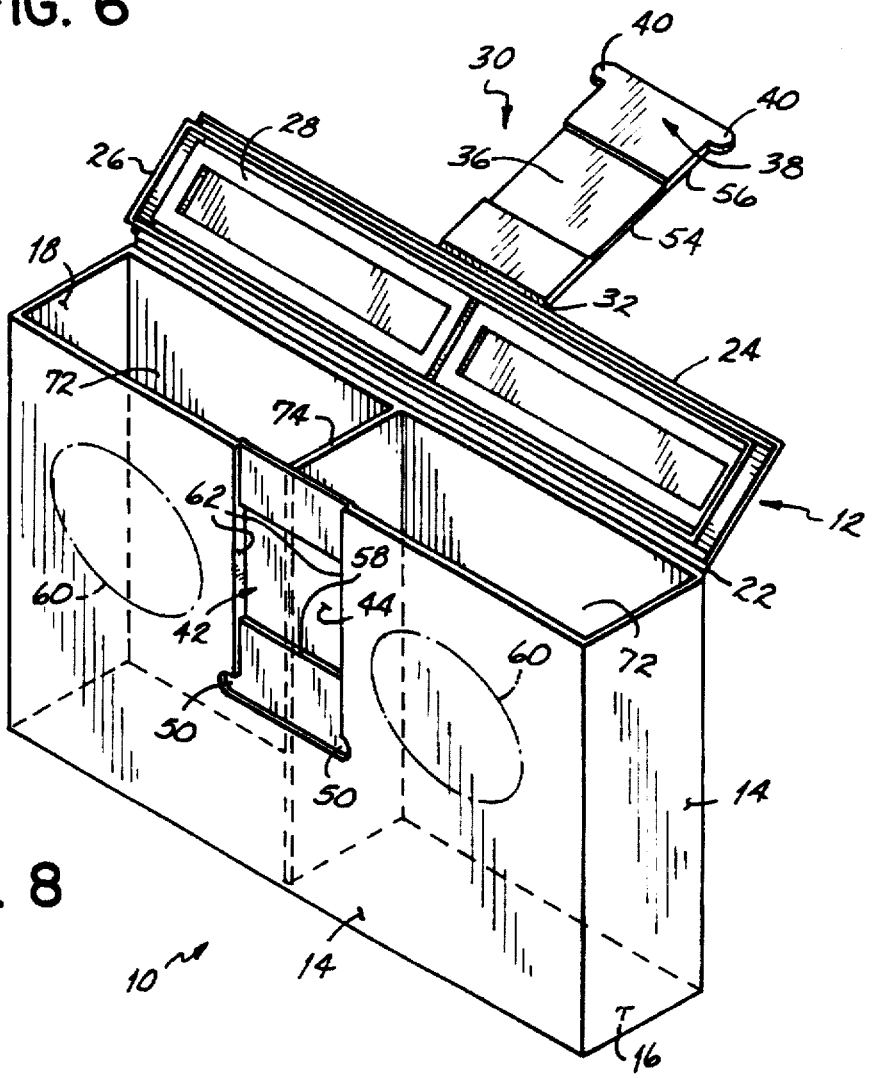
FIG. 8 is a perspective view of a second presently preferred embodiment of a container having multiple compartments and a closure according to this invention.

It will be readily appreciated that although the first presently preferred embodiment shown in FIGS. 1–7 is plastic and in a generally rectangular configuration that other sizes, shapes, materials and dimensions of the container 10 and closure 12 are possible within the scope of this invention. Particularly, a second presently preferred embodiment of the container 10 and closure 12 is shown in FIG. 8 wherein like reference numerals are used to indicate components of the invention similar to those previously described. The container 10 of FIG. 8 is generally rectangular and includes a pair of compartments 72 separated by a dividing wall 74. The compartments 72 are commonly closed by a single closure 12 hingedly connected to the upper rim 18 of the sidewall 14 of the container 10 as previously described. The pressure regions 60 of the sidewall 14 which are depressed while performing the second step in opening the container 10 are located adjacent the recess 42 as shown in FIG. 8.

Figure 9:
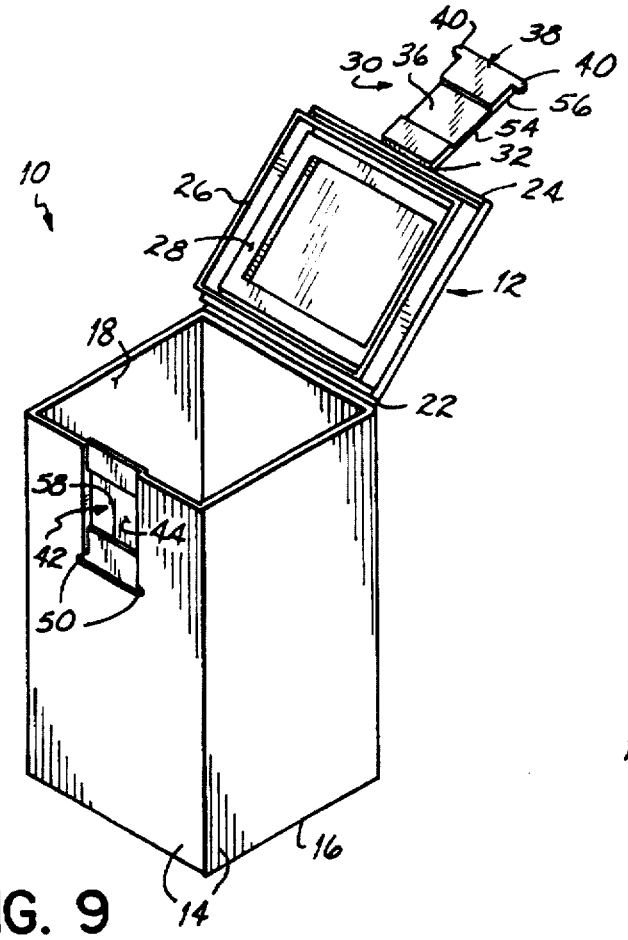
FIGS. 9 and 10 are perspective views of third and fourth, respectively, presently preferred embodiments of the invention.
Figure 10:
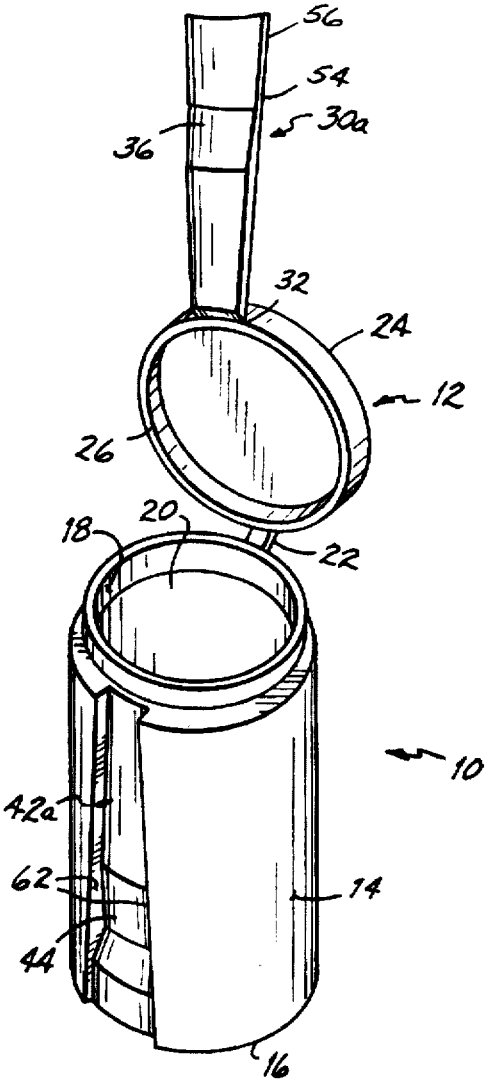

Similarly, a square shaped container 10 according to a third presently preferred embodiment of this invention is shown in FIG. 9. A fourth presently preferred embodiment of the invention is shown in FIG. 10 comprising a cylindrical shaped container 10 and a circular closure 12 connected thereto by the living hinge 22. The latch on the closure 12 of FIG. 10 includes the detent 38 in the form of a tapered latch **30*a*. The recess 42*a* of the sidewall 14 of the cylindrical container 10 and the latch 30*a* are similarly tapered so that they are more narrow proximate the upper rim 18 of the container 10 than wider portions proximate the bottom 16 of the container 10. As a result, with the latch seated in the recess 42*a*, the closure 12 cannot be forced open by merely translating the latch 30*a* within the recess 42*a* or pulling upwardly on the closure 12 due to the interference fit of the tapered shape of the latch 30*a* and recess 42*a*** combination.

Figure 11:
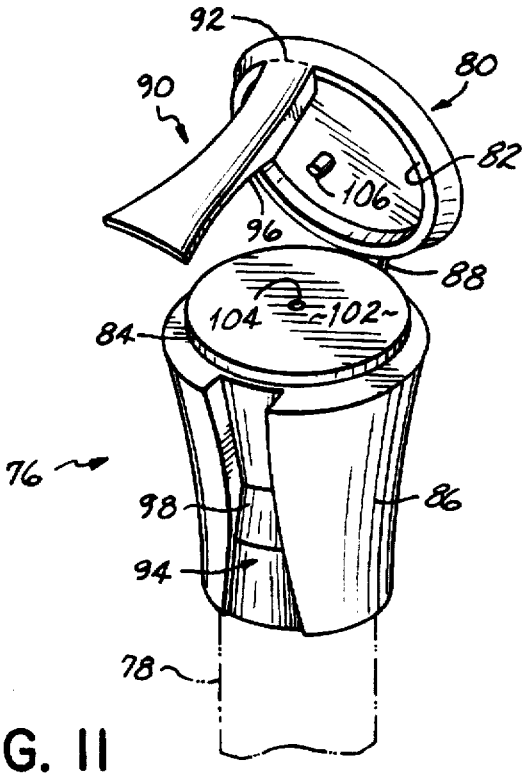
FIG. 11 is a perspective view of a closure assembly according to this invention.

Referring to FIG. 11, the present invention may be embodied within a closure assembly 76 for a container 78 of any configuration (shown in phantom). The closure assembly 76 according to a presently preferred embodiment includes a lid 80 having a downwardly depending lip 82 which is configured and sized to mate with an upper rim 84 on a skirt portion 86 of the assembly 76. The lid 80 is hingedly connected by a living hinge 88 to the skirt portion 86. At a location opposite from the living hinge 88 a latch 90 is connected to the lid 80 by a second living hinge 92. A recess 94 is provided in the skirt portion 86 which is sized and configured to receive therein the latch 90. The latch 90 includes a notch 96 and the recess 94 includes a well 98 which cooperate to define a cavity similar to the previously described embodiments of the invention and the process for opening and closing the closure assembly 76 of FIG. 11 is also similar to that previously described.

The closure assembly 76 may be useful for dispensing cream or fluid from the container 78 and as such, the closure assembly 76 includes a generally planar upper panel 102 having a hole 104 therein through which the fluid contents of the container are dispensed. A stem 106 projects from the underneath surface of the lid 80 to mate with the hole 104 when the closure assembly 76 is closed.

From the above disclosure of the general principles of the present invention and the preceding detailed description of preferred embodiments, those skilled in the art will readily comprehend the various modifications to which this invention is susceptible. For example, the invention has been described with respect to particular sizes, shapes and materials, but is readily compatible with other sizes, shapes and materials. Therefore, we desire to be limited only by the scope of the following claims and equivalents thereof.

We claim:

1. A unitary molded container comprising:

a container body having at least one sidewall and a bottom;

an upper rim of said sidewall defining an opening of said container;

a closure hingedly connected at a first position to said container body and configured to mate with said upper rim and seal said container;

a latch hingedly connected to said closure at a second position generally opposite from said first position;

a recess in said sidewall of said container body, said recess being configured to receive therein said latch when said closure is pivoted to mate with said upper rim;

a detent on said latch to inhibit said closure from being forced from said upper rim while said latch is seated within said recess;

a cavity between said latch and said sidewall when said latch is received in said recess; and a flexible portion of said latch being deflectable into said cavity by a user to dislodge a first portion of said latch from said recess such that said latch can be grasped by a user to pull said closure away from said upper rim and thereby open said container.

2. The container of claim 1 further comprising:

a pressure region on said sidewall which when pressed by said user dislodges a second portion of said latch from said recess after said first portion of said latch is dislodged from said recess.

3. The container of claim 1 further comprising:

a ledge on said sidewall proximate said recess to inhibit said latch from being preyed from said recess.

4. The container of claim 1 further comprising:

a viewing panel providing visual access to contents in said container.

5. The container of claim 1 further comprising:

a notch on said latch, said notch defining at least in part said cavity.

6. The container of claim 1 further comprising:

a well in said recess, said well defining at least in part said cavity.

7. The container of claim I further comprising:

a first living hinge joining said closure and said container body; and a second living hinge joining said closure and said latch.

8. The container of claim 1 wherein said container body, said closure and said latch are integrally molded from plastic.

9. The container of claim 1 further comprising:

a tamper indicator covering at least a part of said latch received in said recess.

10. The container of claim 1 further comprising:

multiple compartments within said container.

11. The container of claim 1 further comprising:

a reinforcing rib proximate a periphery of said closure.

12. The container of claim 1 further comprising:

a ridge on said latch; and a socket in said recess positioned and configured to mate with said ridge when said latch is received therein, said ridge and said socket cooperating to inhibit opening said closure.

13. A unitary molded container comprising:

a container body having at least one sidewall and a bottom;

an upper rim of said sidewall defining an opening of said container;

a closure connected to said container body by a first living hinge, said closure being configured to mate with said upper rim and seal said container;

a latch connected to said closure by a second living hinge at a position generally opposite from said first living hinge;

a recess in said sidewall of said container body, said recess being configured to receive therein said latch when said closure is pivoted to mate with said upper rim;

a detent on said latch to inhibit said closure from being forced from said upper rim while said latch is seated within said recess;

a cavity between said latch and said sidewall when said latch is received in said recess, said cavity being formed by a notch on said latch in cooperation with a well in said recess;

a flexible portion of said latch being deflectable into said cavity by a user to dislodge a first portion of said latch from said recess;

a pressure region on said sidewall which when pressed by said user dislodges a second portion of said latch from said recess after said first portion of said latch is dislodged from said recess such that said latch can be grasped by said user to pull said closure away from said upper rim and thereby open said container.

14. A closure assembly for a container, said closure assembly comprising:

a lid;

a skirt portion, said lid being joined to said skirt portion by a first living hinge;

a latch joined to said lid by a second living hinge at a position opposite from said first living hinge;

a recess in said skirt portion, said recess being configured to receive therein said latch when said lid is in a closed position on said container;

a detent on said latch to inhibit said lid from being forced from said closed position while said latch is received in said recess;

a cavity between said latch and said skirt when said latch is received in said recess; and a flexible portion of said latch being deflectable into said cavity by a user to dislodge a first portion of said latch from said recess such that said latch can be grasped by said user to pull said lid from said closed position and thereby open said container.

15. The closure assembly of claim 14 further comprising:

a pressure region on said skirt which when pressed by said user dislodges a second portion of said latch from said recess after said first portion of said latch is dislodged from said recess.

16. The closure assembly of claim 14 further comprising:

a notch on said latch, said notch defining at least in part said cavity.

17. The closure assembly of claim 14 further comprising:

a well in said recess, said well defining at least in part said cavity.

18. The closure assembly of claim 14 wherein said lid, said skirt and said latch are integrally molded from plastic.

19. The closure assembly of claim 14 further comprising:

a tamper indicator covering at least a part of said latch received in said recess.

20. A closure assembly for a container, said closure comprising:

a lid;

a skirt portion, said lid being joined to said skirt portion by a first living hinge;

a latch joined to said lid by a second living hinge at a position opposite from said first living hinge;

a recess in said skirt portion, said recess being configured to receive therein said latch when said lid is in a closed position on said container;

a detent on said latch to inhibit said lid from being forced from said closed position while said latch is received in said recess;

a cavity between said latch and said skirt when said latch is received in said recess, a notch on said latch and a well in said recess cooperating to form said cavity;

a flexible portion of said latch being deflectable into said cavity by a user to dislodge a first portion of said latch from said recess; and a pressure region on said skirt which when pressed by said user dislodges a second portion of said latch from said recess after said first portion of said latch is dislodged from said recess such that said latch can be grasped by a user to pull said lid from said closed position and thereby open said container;

wherein said lid, said skirt and said latch are integrally molded from plastic.

21. A method of opening a container comprising the steps of:

pressing a flexible portion of a latch into a cavity between said latch and a sidewall of said container, said latch being initially seated within a recess on said sidewall of said container and said pressing thereby dislodging a first portion of said latch from said recess;

squeezing a region of said sidewall to dislodge a second portion of said latch from said recess;

pulling said latch upwardly and thereby lifting a closure connected to said latch by a first living hinge from sealing engagement with said container, said closure being joined to said container by a second living hinge located at a position opposite from said first living hinge on said closure.

22. The method of claim 21 further comprising:

tearing a tamper evident label covering at least a part of said latch received in said recess, said tearing step being accomplished before said pressing step.

* * * * *